US006615808B2

(12) United States Patent
Streib

(10) Patent No.: US 6,615,808 B2
(45) Date of Patent: Sep. 9, 2003

(54) METHOD FOR CHECKING THE TIGHTNESS OF AN AUTOMOTIVE TANK SYSTEM

(75) Inventor: Martin Streib, Vaihingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/958,540

(22) PCT Filed: Jan. 25, 2001

(86) PCT No.: PCT/DE01/00288

§ 371 (c)(1),
(2), (4) Date: Nov. 30, 2001

(87) PCT Pub. No.: WO01/59287

PCT Pub. Date: Aug. 16, 2001

(65) Prior Publication Data

US 2002/0157654 A1 Oct. 31, 2002

(30) Foreign Application Priority Data

Feb. 11, 2000 (DE) ..... 100 06 186

(51) Int. Cl.[7] ..... F02M 33/02
(52) U.S. Cl. ..... 123/520; 123/198 D
(58) Field of Search ..... 123/520, 519, 123/518, 516, 521, 198 D

(56) References Cited

U.S. PATENT DOCUMENTS 5,685,279 A * 11/1997 Blomquist et al. ..... 123/520
5,890,474 A 4/1999 Schnaibel et al.
6,131,550 A 10/2000 Fritz et al.
6,161,423 A * 12/2000 Okuma ..... 73/40
6,321,728 B1 * 11/2001 Ohkuma ..... 123/520

FOREIGN PATENT DOCUMENTS

| | | |
|---|---|---|
| DE | 197 55 401 | 2/1998 |
| FR | 2731467 | 9/1996 |
| FR | 2781881 | 2/2000 |
| JP | 11 343926 | 12/1999 |

* cited by examiner

*Primary Examiner*—Mahmoud Gimie
(74) *Attorney, Agent, or Firm*—Walter Ottesen

(57) ABSTRACT

A method for checking the tightness of a tank system of a vehicle wherein one introduces, with the aid of a pressure source, an overpressure relative to the atmospheric pressure over a pregiven time interval alternately into the tank system and a reference leak of a defined size connected in parallel to the tank system and detects at least one operating characteristic variable of the pressure source when introducing the pressure into the tank system (tank measurement) as well as when introducing into the reference leak (reference measurement) and compares the tank measurement to the reference measurement and, when there is a deviation of the tank measurement from the reference measurement by a pregiven value, drawing a conclusion as to a leak, is characterized in that, when a conclusion as to a leak is drawn, introducing pressure into the tank system over a further time interval, lengthening the tank measurement, thereafter executing a renewed reference measurement and outputting a fault announcement "leak" only when, by the latest, after the elapse of the further time interval, the tank measurement deviates from the renewed reference measurement likewise by a pregivable value.

7 Claims, 2 Drawing Sheets

(State of the Art)

METHOD FOR CHECKING THE TIGHTNESS OF AN AUTOMOTIVE TANK SYSTEM

FIELD OF THE INVENTION

The invention relates to a method for checking the tightness of a tank system of a vehicle.

BACKGROUND OF THE INVENTION

A method of this kind is disclosed, for example, in U.S. Pat. Nos. 5,890,474 and 6,131,550.

A method of this kind is disclosed, for example, in German patent publications 196 36 431 or 198 09 384.

In these methods, air is pumped into the tank system by the pressure source. A pressure is built up in this manner in a tight tank system. The increased pressure changes the operating characteristic variable of the pressure source, that is, for example, the electrical current requirement of the pump of the pressure source is increased. The measurement of the pump current therefore defines an index for the pressure in the tank. The pump current is measured at the start of the pumping operation and after the elapse of a predetermined time interval. For a tight tank system, an increase of the current is expected because of the pressure which builds up. A fault announcement "large leak" is outputted when the current increase drops below an expected pregivable index.

In contrast, a fine leak check takes place in that first pumping takes place against the reference leak of approximately 0.5 mm diameter. The reference current required for this purpose is measured. Thereafter, the tank system is pumped up so long until, for a tight tank, a current level is reached which is greater than or equal to the reference current. If this current level is not reached after a pregiven time or no positive current gradient is present any longer below this current level, then the pumping is interrupted and the reference current is measured again. If it is confirmed that this reference current still lies above the pump current level reached, then a conclusion is drawn as to a fine leak in the region of 0.5 to 1 mm.

Experiments of this method in vehicles under real environmental conditions have shown that the current of the pump can drift even for constant pressure. This drift is especially pronounced for ambient humidity. First, an increase and subsequently a slow drop-off of the current is observed. This drop-off can compensate the current increase expected from the pressure buildup. In this way, and under some circumstances, a conclusion is drawn as to a leak without one being present. Furthermore, fuel condensation effects can indicate a similar compensating action.

SUMMARY OF INVENTION

In view of the above, it is an object of the invention to further develop a method of the species type so that it can be used for practically all ambient conditions and ambient influences, especially for ambient humidity or moisture.

This object is solved in a method for checking the operability of a tank system of the above-described type in accordance with the invention. The basic idea of the invention is to extend the tightness check when a conclusion is drawn as to a leak in order to obtain more precise knowledge or, if required, a confirmation as to whether or if a leak is actually present. If a suspicion of a large leak or a fine leak occurs during a tightness check, then the check is not ended with a fault announcement but is extended. The tank is pumped up further until the pumping time is reliably sufficient to achieve the same pressure level for a tight tank as for pumping against the reference leak. At the end of the tank measurement, pumping against the reference leak takes place once again for a short time so that only a short time span lies between the reference measurement and the tank measurement. It is very improbable that significant current drifts occur within this time interval. Even when during the extended tightness check a drift of the tank measurement occurs (for example, the current requirement of the pump drops off), this is compensated by the comparison to the subsequent reference measurement.

In this way, the influence of moisture or other instabilities of the operating characteristic variable are no longer of any practical consequence, for example, current instabilities of the pump. Even negative gradients of the tank measurement, for example, negative current gradients, which occur because of drying of the pump or because of fuel condensation, cannot lead to an incorrect fault announcement "leak" because, between the renewed tank measurement and the renewed reference measurement, only a very short time interval is present in which drying effects of the pump or fuel condensations cannot really have an effect.

If, after an extended tank measurement and the subsequent immediately following renewed reference measurement, the tank measurement deviates by a pregivable value from the reference measurement (for example, the pump current for the tank measurement is less than the pump current for the reference measurement and therefore a conclusion is to be drawn as to a fault), it can be provided in an advantageous embodiment that one carries out a further tightness check including a further reference measurement as well as a further tank measurement over an extended further time interval, that is, over an extended pumping time. A fault announcement is only outputted when the further reference measurement deviates from the further tank measurement by a pregivable value after the elapse of this extended time interval.

Advantageously, the further reference measurement and the further tank measurement are carried out during a later driving cycle of the vehicle.

As mentioned, operating variables can be the pump current, that is, the current takeup of the pump of the pressure source as well as the rpm of the pump and/or the voltage applied to the pump.

When utilizing the pump current as an operating variable, the fault announcement "leak" is only outputted when the current, which is measured during the tank measurement, is less than the current, which is measured during the reference measurement. Stated otherwise, the tank measurement deviates from the reference measurement by a negative value of the pump current.

The reference leak can, for example, be arranged parallel to the tank system; however, it can be simulated in another embodiment by a controlled partial opening of the tank-venting valve.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
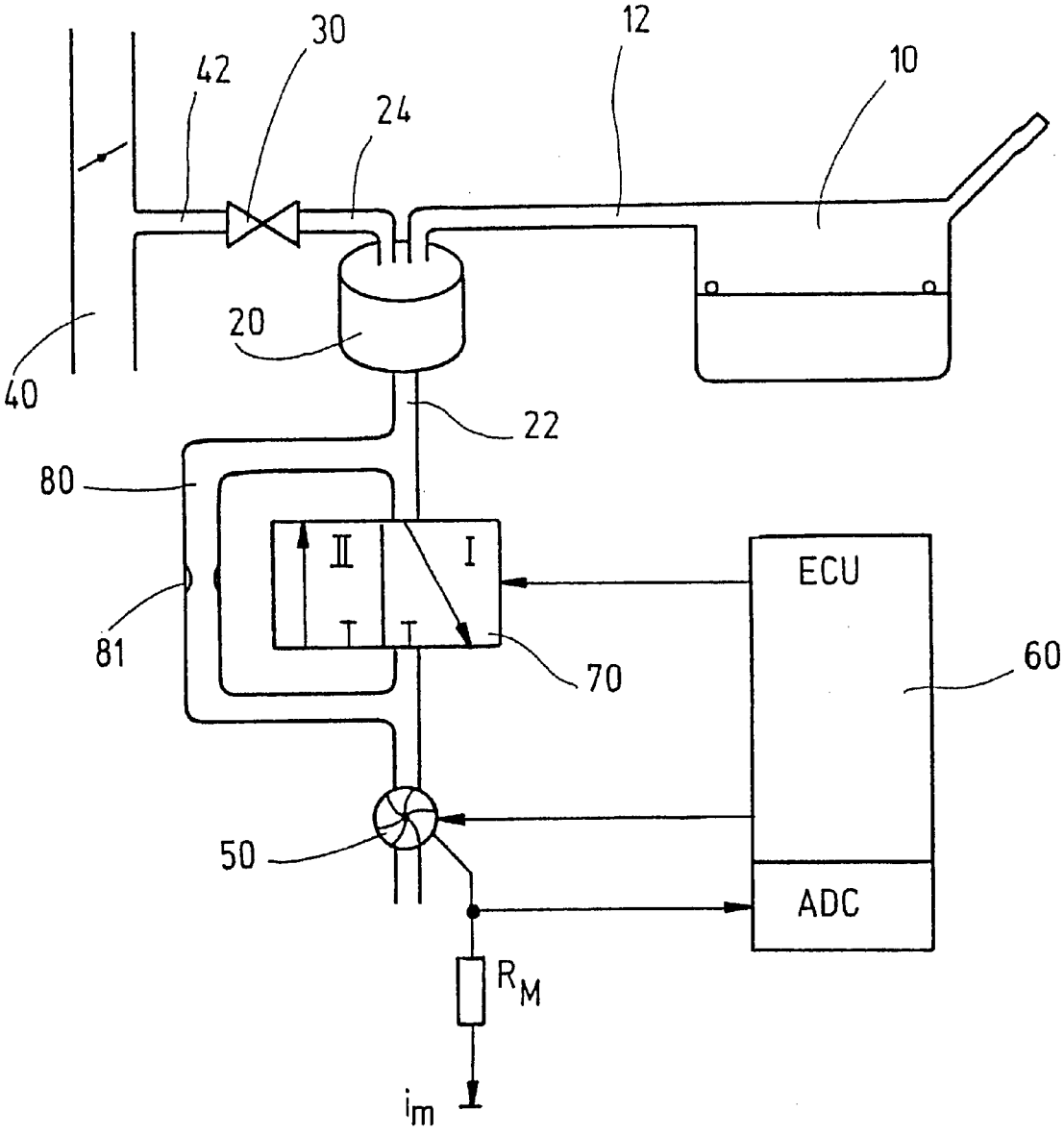
FIG. 1 shows a tank system known from the state of the art wherein the method, which makes use of the invention, is applied; and, FIG. 2 shows the characteristic time-dependent trace of the motor current of the overpressure pump of the tank system shown in FIG. 1 for different operating states.

A tank system of a motor vehicle is shown in FIG. 1 which is known from the state of the art. The tank system includes a tank 10, an adsorption filter 20, for example, an active charcoal filter, which is connected to the tank 10 via a tank-connecting line 12 and a venting line 22 connectable to the ambient as well as a tank-venting valve 30, which, on the one hand, is connected to the adsorption filter 20 via a valve line 24 and, on the other hand, is connected to an intake manifold 40 of an internal combustion engine (not shown) via a venting line 42.

Hydrocarbons develop in the tank 10 because of vaporization and these hydrocarbons deposit in the adsorption filter 20. To regenerate the adsorption filter 20, the tank-venting valve 30 is opened so that air of the atmosphere is drawn by suction through the adsorption filter 20 because of the underpressure present in the intake manifold 40 whereby the hydrocarbons which have deposited in the adsorption filter 20, are drawn into the intake manifold 40 by suction and are supplied to the internal combustion engine.

A pump 50 is provided in order to be able to diagnose the operability of the tank system. The pump 50 is connected to a circuit unit 60. A changeover valve 70 is connected downstream of the pump 50 and is, for example, in the form of a 3/2 directional valve. Parallel to this changeover valve 70, a reference leak 81 is arranged in a separate branch 80. The size of the reference leak 81 is so selected that it corresponds to the size of the leak to be detected. The size amounts, for example, to 0.5 mm.

It is understood that the reference leak 81 can, for example, also be part of the changeover valve 70, for example, by a channel constriction or the like so that, in this case, an additional reference part is unnecessary (not shown).

For checking the tightness of the tank system, the pump 50 is actuated and an overpressure is thereby introduced alternately into the tank system and (via a switchover of the valve 70) into the reference leak 81. Here, the current $i_m$, which is to be supplied to the pump motor and drops across a resistor $R_m$, is detected and is supplied to the circuit unit 60. The trace, which is identified by (b) in FIG. 2 corresponds to the time-dependent trace of the motor current of an operable tank system without a leak. In the time interval shown by I, the changeover valve 70 is in the position shown in FIG. 1 and identified by I. In this position of the changeover valve 70, a pumped flow is introduced into the tank system by the pump source 50 via the reference leak 80. A motor current $i_m$, which is essentially constant over time, adjusts as shown schematically in FIG. 2. As soon as the changeover valve 70 is switched over from the position I into the position II, the pump source 50 charges the tank system with an overpressure. When switching over, the motor current $i_m$ first drops rapidly and, thereafter, increases continuously with increasing time until it reaches a value which is greater than or equal to the motor current $i_m$ in the position I of the changeover valve 70. If one, in lieu thereof, would measure in the reference position for the whole time, then the line identified in FIG. 2 by (a) would result without influence of disturbances. This line is dotted and is essentially constant.

If the motor current of the tank measurement reaches the value of the motor current of the reference measurement or exceeds the same after the elapse of a pregiven time interval $t_1$, then the tightness check is ended and no fault announcement "leak" is outputted. This is shown exemplary in FIG. 2 with the two time-dependent traces of the reference measurement and the tank measurement with the two traces being identified by (a) and (b), respectively. A trace of the motor current of this kind is characteristic for an operable tank system.

Figure 2:
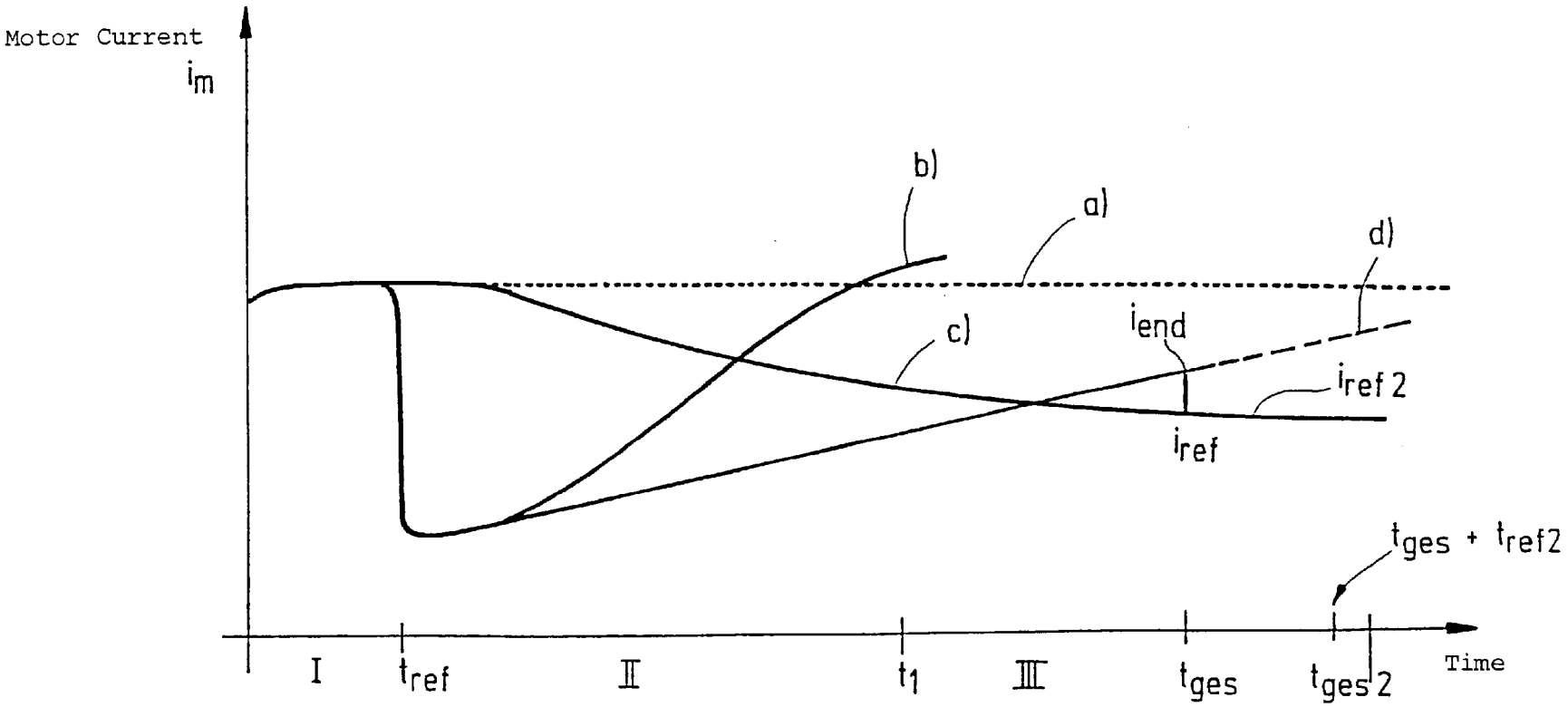

The suspicion as to a fine leak is present if, in contrast, the motor current of the pump has not yet reached the reference value after this time $t_1$ (as shown in FIG. 2 with respect to the curve identified by (d)) or if, after the elapse of time $t_1$, it has been determined that the motor current of the tank measurement no longer increases even though this current still lies below the value of the reference measurement. If a missing gradient causes this suspicion and a time $t_{ges}$ has not yet been reached, pumping continues until the total pumping time $t_{ges}$ is reached, which can be selected in dependence upon the tank fill level. The motor current of the pump (pump current), which is reached at time $t_{ges}$, is measured and is, for example, stored as $i_{end}$. Directly thereafter, pumping is once more taken up against the reference leak and the reference current $i_{ref}$ is measured anew. The tightness check is ended and no fault announcement is outputted when the current $i_{end}$ is greater or equal to $i_{ref}$ after this renewed reference measurement even when $i_{end}$ is less than the current value of the first reference measurement. This is schematically shown in FIG. 2 with respect to a time-dependent trace of the motor current of a reference measurement with drift identified by (c) as well as with respect to the trace of the motor current of a tank measurement having drift identified by (d).

As shown in FIG. 2, the motor current $i_m$ of the tank measurement (d) exceeds, after the elapse of a time interval identified by III, the value of the motor current which would adjust at this time point for a reference measurement identified by (c) even though a drift of the current level is present, for example, because of ambient influences such as moisture or the like. For this reason, a renewed reference measurement is carried out directly after the elapse of the total pump time $t_{ges}$. For this renewed reference measurement, a time interval of $t_{ges}$ to $t_{ges}+t_{ref2}$ of the trace of the reference measurement (identified by (c)) is detected for a current drift. This time interval is preferably selected as large as the time interval of the first reference measurement identified by I.

If, in contrast, after the elapse of the total pump time $t_{ges}$, the end value $i_{end}$ is less than the new reference $i_{ref}$ (not shown in FIG. 2), then a fault announcement "fine leak" is outputted or the check is repeated again. In a later driving cycle, the total pump time $t_{ges}$ can be extended to, for example, a value $t_{ges2}$.

The above-described fine-leak check can follow a large leak check which takes place essentially equivalent to the described fine-leak check. The coarse-leak check includes, for example, the following steps:

- start of the first reference measurement;
- storage of the first reference measurement $i_{ref}$ after approximately 10 seconds;
- switchover to tank measurement and measurement of a current $i_0$ after the switchover;
- after a pregiven time, for example 30 seconds, measure the pump current $i_m$ and storage of the value as $i_1$. If $i_1>i_0+a$ pregiven quantity, then end the coarse-leak check—no coarse leak is present;
- if $i_1<i_0+a$ pregiven quantity, then a short switchover to the reference leak and the execution of a reference measurement with a storage of the value as $i_{ref}$;
- if $i_1 \geqq i_{ref}$, then no large leak is present. In this case, the tank is tighter than with a leak having the size 0.5 mm.

In this case, the tightness check is ended. The reason that, in this case, $i_1<i_0+a$ pregiven quantity and nonetheless is greater than the current value $i_{ref}$, is very probably a reduction of the pump current requirement because of a drying effect after an influence of moisture;

if, in contrast, $i_1<i_{ref}$, then the suspicion, as before, is present as to leakage. It can, however, also be that no leakage is present but the pump time is not sufficient in order to build up a pressure in the tank comparable to the reference leak. For this reason, pumping takes place anew over a further time interval. This further time interval corresponds essentially to the expected time duration for the fine-leak check for the tank level present at that time. After elapse of this further time interval, the actual pump current is stored as $i_2$ and a reference measurement is undertaken directly thereafter. If the current $i_2$ is equal to or greater than $i_{ref}$, then a conclusion can be drawn as to a tank which is tighter than with a leak having the size of 0.5 mm. The tightness check can be interrupted without a fault announcement. This result can even be interpreted as a fine-leak check;

if the value $i_2$ does not completely reach the value $i_{ref}$ but is only slightly less than this value, then a conclusion can possibly be drawn that no large leak is present so that the large leak check can likewise be ended without a fault announcement. If, in contrast, $i_1$ is less than $i_{ref}-\Delta$ (with $\Delta$ being a pregivable quantity), then the result "large leak" is diagnosed and a fault announcement is outputted. Alternatively, and in lieu of an immediate fault announcement, the tightness check which is explained in greater detail above, can be executed once again with a lengthened time interval.

The basic idea and advantage of the present invention is that, when a suspicion as to a leak is present because of a tank measurement and a reference measurement, a lengthened tank measurement and, after running through this extended tank measurement, a reference measurement is immediately made and that only after a comparison between this reference measurement and the lengthened tank measurement and, when there is a deviation of the tank measurement from the renewed reference measurement by a pregivable value, a fault announcement is outputted. In this way, drifts in the pump current, for example, caused by moisture influences or other ambient influences, during the tightness check are eliminated.

What is claimed is:

1. A method for checking the tightness of a tank system of a vehicle, the method comprising the steps of:

introducing an overpressure relative to the atmospheric pressure over a pregiven time interval utilizing a pressure source alternately into the tank system and a reference leak of a defined size connected in parallel to the tank system;

detecting at least one operating characteristic variable of said pressure source when introducing the pressure into the tank system to provide a tank measurement as well as when introducing an overpressure into said reference leak to provide a reference measurement;

comparing the tank measurement to the reference measurement;

when there is a deviation of the tank measurement from the reference measurement by a pregiven value, drawing a conclusion as to a leak;

when a conclusion as to a leak is drawn, introducing pressure into the tank system over a further time interval and lengthening said tank measurement;

thereafter, executing a renewed reference measurement; and, outputting a fault announcement "leak" only when, by the latest, after the elapse of said further time interval, the tank measurement deviates from the renewed reference measurement likewise by a pregivable value.

2. The method of claim 1, wherein: when there is a deviation of the lengthened tank measurement from the renewed reference measurement in advance of the output of a fault announcement "leak", a further tank measurement and a further reference measurement are executed in a lengthened additional time interval and the fault announcement "leak" is only outputted when, by the latest, after the elapse of the extended additional time interval, also the further tank measurement deviates from the additional reference measurement by a pregivable value.

3. The method of claim 2, wherein the additional tank measurement and the further reference measurement are executed during or after a later driving cycle of the vehicle.

4. The method of claim 2, the method comprising the further step of utilizing, as at least one operating characteristic value, one or several of the following variables: the current takeup of the pressure source and/or the rpm of the pressure source and/or the voltage applied to the pressure source.

5. The method of claim 1, wherein, when using the pump current as operating characteristic variable, the fault announcement "leak" is only then outputted when the current, which is measured for the tank measurement, is less than the current which is measured for the reference measurement.

6. The method of claim 1, comprising the further step of connecting the reference leak in parallel to the tank system.

7. The method of claim 1, comprising the further step of simulating the reference leak by controlled partial opening of a tank-venting valve.

* * * * *